US006019168A

United States Patent [19]

Kinnersly

[11] Patent Number: 6,019,168

[45] Date of Patent: Feb. 1, 2000

[54] HEAT EXCHANGERS

[75] Inventor: Richard Furneaux Kinnersly, West Wellow, United Kingdom

[73] Assignee: Sustainable Engine Systems Limited, London, United Kingdom

[21] Appl. No.: 08/793,569

[22] PCT Filed: Sep. 4, 1995

[86] PCT No.: PCT/GB95/02086

§ 371 Date: Feb. 27, 1997

§ 102(e) Date: Feb. 27, 1997

[87] PCT Pub. No.: WO96/07864

PCT Pub. Date: Mar. 14, 1996

[30] Foreign Application Priority Data

Sep. 2, 1994 [GB] United Kingdom ..... 9417623

[51] Int. Cl.[7] ..... F28D 7/10

[52] U.S. Cl. ..... 165/154; 165/155

[58] Field of Search ..... 165/154, 155

[56] References Cited

U.S. PATENT DOCUMENTS

| | | | |
|---|---|---|---|
| 813,918 | 2/1906 | Schmitz | 165/154 X |
| 3,717,993 | 2/1973 | Potter | 60/24 |
| 3,986,551 | 10/1976 | Kilpatrick . | |
| 4,086,959 | 5/1978 | Habdas . | |
| 4,228,848 | 10/1980 | Wadkinson, Jr. | 165/11.1 |
| 4,778,002 | 10/1988 | Allgäuer et al. . | |
| 4,821,797 | 4/1989 | Allgäuer et al. . | |
| 4,862,955 | 9/1989 | Itakura . | |

FOREIGN PATENT DOCUMENTS

| | | | |
|---|---|---|---|
| 0 582 835 A1 | 2/1994 | European Pat. Off. . | |
| 778461 | 3/1935 | France | 165/155 |
| 107259 | 11/1898 | Germany | 165/155 |
| 28 41 482 | 7/1979 | Germany . | |
| 36 43 782 A1 | 7/1988 | Germany . | |
| WO 88/05150 | 7/1988 | Germany . | |
| 56-37489 | 4/1981 | Japan | 165/155 |
| 2 201 504 | 9/1988 | United Kingdom . | |
| 2 261 280 | 5/1993 | United Kingdom . | |

*Primary Examiner*—Allen Flanigan
*Attorney, Agent, or Firm*—Davis and Bujold

[57] ABSTRACT

A heat exchanger element comprises an outer tube (11), an inner tube (12) within the outer tube and a first fluid flow path for a first heat exchange fluid formed between the inner and outer tubes. A second heat exchange fluid is in heat transfer relation to the outer surface of the outer tube and/or the inner surface of the inner tube. A sleeve (13) is provided within the first fluid flow path between the inner and outer tubes. The sleeve defines an outer interface (16) with the inner surface of the outer tube and an inner interface (14) with the outer surface of the inner tube. Generally longitudinal grooves (16,17) are provided at each interface to provide together the first fluid flow path.

12 Claims, 4 Drawing Sheets

HEAT EXCHANGERS

The invention relates to heat exchangers and heat exchanger elements and in particular but not exclusively to such heat exchanger elements for use in Stirling engines.

Stirling engines require small heat exchangers with high rates of heat transfer and may also require high strength so that they can operate reliably under high pressures. It is also important for them to have a small volume for the working fluid of the engine to help minimise the engine dead space. High heat transfer rates to a small volume of fluid lead to a requirement for a high heat transfer surface to volume ratio within the heat exchanger. These requirements apply to the heater normally employed to transfer heat from combustion gases to a working fluid and to a cooler to transfer heat from the working fluid in a different phase of the Stirling engine cycle. For the heater, there is also a requirement to operate at high temperatures.

It is known from GB A 2 261 280 to provide a heat exchanger element comprising an outer tube, an inner tube within the outer tube, a first fluid flow path for a first heat exchange fluid formed between the inner and outer tubes and means for providing a second heat exchange fluid in heat transfer relation to the outer surface of the outer tube and/or the inner surface of the inner tube.

According to the present invention a heat exchanger element of this kind is characterised by a sleeve within the first fluid flow path between the inner and outer tubes defining an outer interface with the inner surface of the outer tube and an inner interface with the outer surface of the inner tube and by generally longitudinal grooves at each interface to provide together the first fluid flow path.

The known heat exchanger provides a greater area for heat transfer than an annular gap by means of longitudinal ribs on the tubes within the first fluid flow path. The prior proposal also provides breaks in the ribs to break up laminar flow within the first fluid flow path and further improve heat transfer. There is a practical limit to the extent that heat transfer characteristics can be improved in this way. For example, increasing the number of ribs requires a reduction in their thickness which reduces heat conduction to the tubes themselves along the ribs and also leads to fragility and manufacturing difficulties. The volume for the first fluid also remains relatively high.

By providing an additional sleeve and grooves in accordance with the present invention, a large and effective heat transfer surface can be achieved with a small internal fluid volume, resulting in a high heat transfer surface to volume ratio.

The sleeve may be in intimate heat exchange contact with at least one of the tubes. With this arrangement, an effective heat flow path exists as: first fluid; sleeve; tube; second fluid or vice versa. For this purpose, the sleeve may be shrunk on to or in to a tube. Alternatively, differential expansion may be such that contact between sleeve and tube is most effective only at operating temperatures when effective heat transfer is most important. Electron beam welding may be used to provide even more intimate contact. Good contact in part depends on precision manufacture, both as regards surface finish and dimensions.

Alternatively, the sleeve may be provided primarily as a spacer, to direct fluid through the grooves and provide most or all of the heat transfer directly between the fluid and the tubes.

In addition to the grooves described above, which are referred to as main grooves, secondary grooves in the tubes and or sleeve may be provided at an inclination to the main grooves. These secondary grooves may be provided in either surface forming the interface between tube and sleeve. On assembly, these secondary grooves form slots down which a relatively small degree of fluid flow from one main groove to the next can be induced. This fluid flow can be controlled so as to create a degree of spiral flow in a desired direction down the main grooves. This in turn allows control of the relationship between laminar and turbulent fluid flow, and thus contributes to optimisation of heat transfer for given exchanger dimensions, parameters of the first fluid and fluid drag characteristics.

It may be convenient to provide main grooves in one surface and secondary grooves in the other surface at the same interface. For example, main grooves may extend axially and be formed by casting or extrusion or machining. Secondary grooves may then be formed by machining. Of course, secondary grooves could be machined on to the same surface on which main grooves have previously been cast, extruded or machined.

Main grooves may be provided in both surfaces at an interface, in which case they may be in register to provide in effect larger grooves or out of register to in effect prove larger numbers of grooves.

Embodiments of the invention are described with reference to the accompanying drawings in which.

Figure 1:
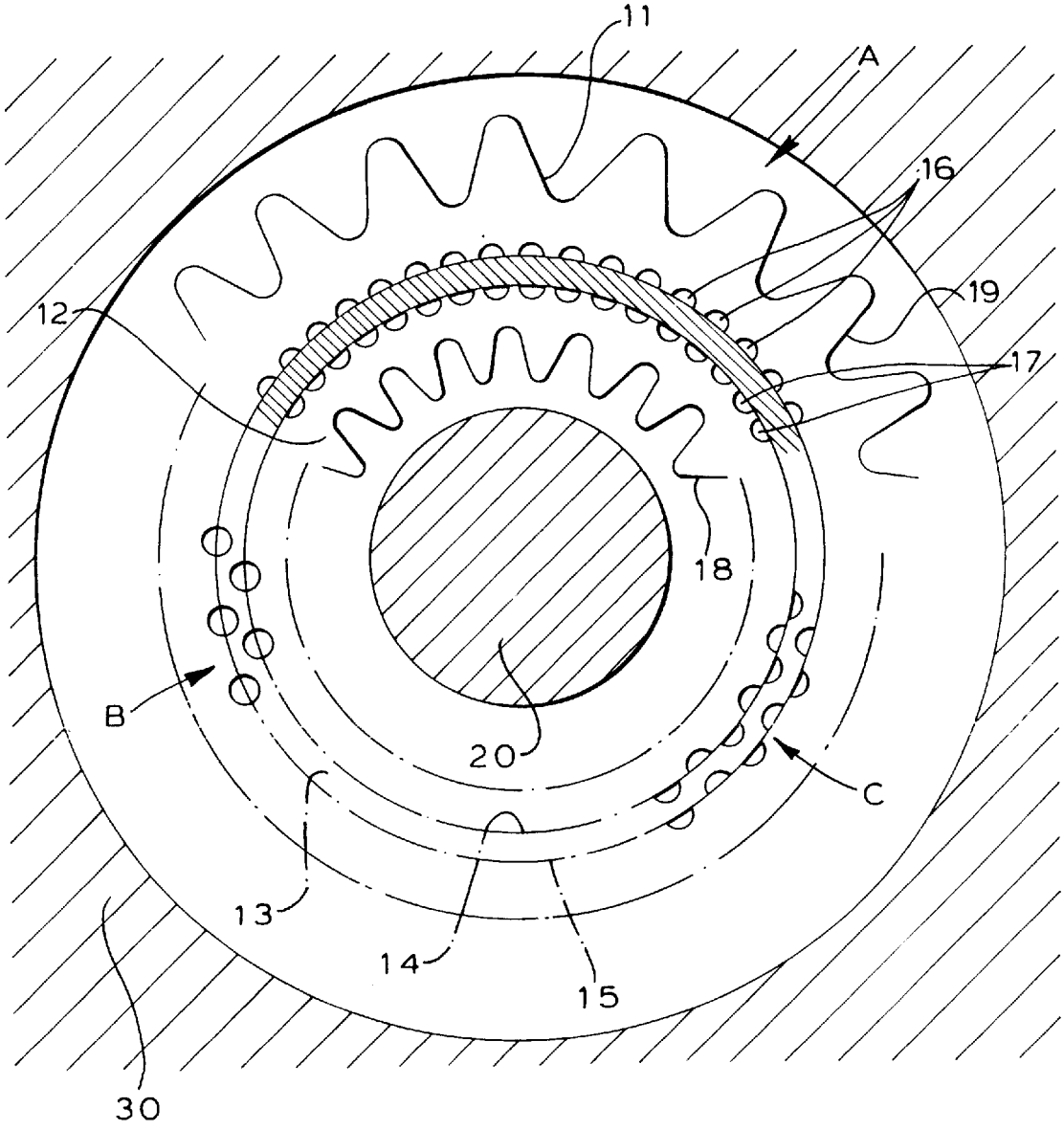
FIG. 1 is a diagrammatic cross section through a heat exchanger element in accordance with the invention.
Figure 2:
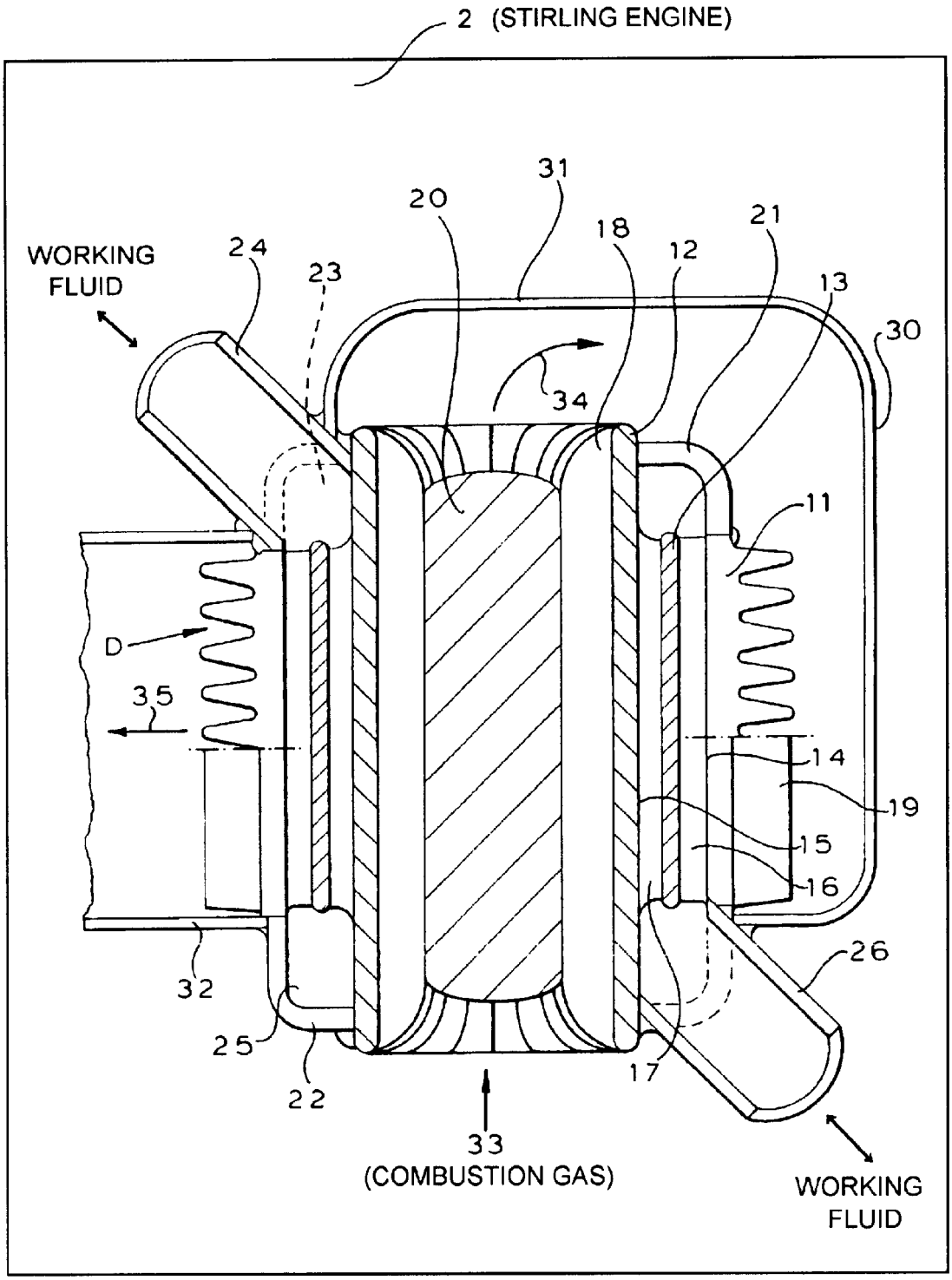
FIG. 2 is a diagrammatic longitudinal section of the heat exchanger element of FIG. 1 for a Stirling engine shown by the labeled rectangular box.

FIGS. 1 and 2 show a heat exchanger element having an outer tube 11 and an inner tube 12 concentric with and within the outer tube. A sleeve 13, typically of about 0.5 to 1 mm wall thickness, is positioned concentrically between the inner and outer tubes forming an inner interface 14 between the inner tube and the sleeve and an outer interface 15 between the sleeve and the outer tube. These interfaces may involve intimate mechanical contact between sleeve and tube or may involve light contact or near contact.

As shown in region A, outer main grooves 16 are provided in the inner surface of the outer tube 11 at interface 15 and extend longitudinally of the tube. In a typical case for tubes of about 90 mm diameter at the interfaces, there may be 90 D-shaped main grooves of 3 mm radial depth and 2 mm circumferential width. These grooves co-operate with the surface of the sleeve to form longitudinal passages. If the tube is an extrusion or casting, these grooves may be formed by the extrusion or casting. Alternatively the tube could be machined. In a similar way, main grooves 17 are provided in the outer surface of the inner tube at the interface 14. In practice, the groove pattern illustrated in the top half of FIG. 1 is repeated around the whole of the circumference of the element but for convenience of illustration not all of the grooves or of some other parts of the element are illustrated. Also, for convenience of illustration, alternative main groove arrangements are shown at different points around the periphery. In region B, the main grooves in the tubes have been supplemented by corresponding main grooves in the sleeve in register with the main grooves in the tubes. In region B, to permit slots of substantial depth for a given sleeve thickness, the inner and outer grooves are at accurately defined relative positions so that inner and outer sleeve grooves do not coincide. In practice, with main grooves in the sleeve, the sleeve thickness is increased to accommodate the grooves.

At region C, the main groove arrangement corresponds to that at B except that the sleeve has in effect been rotated through an angle equivalent to half the pitch between main grooves, creating twice as many passages at C as there are circular passages at B.

As is explained below in relation to FIG. 2, all of the passages formed by the main grooves at the interfaces 14 and 15 are connected together at their ends to form a first fluid flow path for a first heat exchange fluid. The arrangement of main grooves provides an accurately defined fluid flow path with an opportunity for increased surface area for heat transfer between tube and fluid in conjunction with a small fluid volume. When the sleeve is also in intimate contact with one or both of the tubes, the sleeve provides still further effective surface area for heat transfer.

The interior surface of the inner tube and the exterior surface of the outer tube both may have integral fins 18 and 19 to increase their effective areas for heat transfer. A second heat transfer fluid is in use in contact with these surfaces so that heat can be transferred between the two fluids. A stuffer 20 is provided in the interior of the inner tube to guide the second fluid into close proximity with the inner tube. An outer housing 30 similarly defines an outer region for contact between the second fluid and the outer tube.

As shown in FIG. 2, the heat exchanger incorporates an upper end connector 21 and a lower end connector 22. The inner tube 12 extends at both ends beyond the outer tube 11 and sleeve 13. Upper connector 21 is an annular member which bridges between the outer tube 11 and the inner tube 12, forming a plenum 23. The connector also has an inlet/outlet tube 24 for the first heat exchange fluid. Lower connector 22 corresponds to connector 21 with plenum 25 and an outlet/inlet 26. By means of these connectors, a common fluid flow path for the first heat exchange fluid is provided through the main grooves such as 16 and 17. Stuffer 20 is also shown clearly in FIG. 2.

Ducting such as shown at 31 and 32 in conjunction with outer housing 30 provides a fluid flow path for a second fluid as indicated by arrows 33, 34 and 35 through the interior of the inner tube and around the outer tube in order to provide a second fluid flow path for the second heat exchange fluid. A slight modification of the heat exchanger of FIG. 2 is shown at D where the longitudinal fins 11 have been replaced by circumferential fins which may be more appropriate depending on the details of the second fluid flow path.

For a Stirling engine heater, a bank of elements as shown in FIG. 1 and FIG. 2 may be employed with suitable ducting corresponding to ducting 31, 32 to direct the second working fluid through and around the elements. The first fluid is then the working fluid of the Stirling engine 2 and the second fluid is combustion gas for heating the working fluid.

As an alternative to a positively directed second fluid flow path, there may be some situations where the heat exchanger element is simply immersed in a second fluid which will tend to flow by convection or other means to provide sufficient movement for effective heat transfer.

Figure 3:
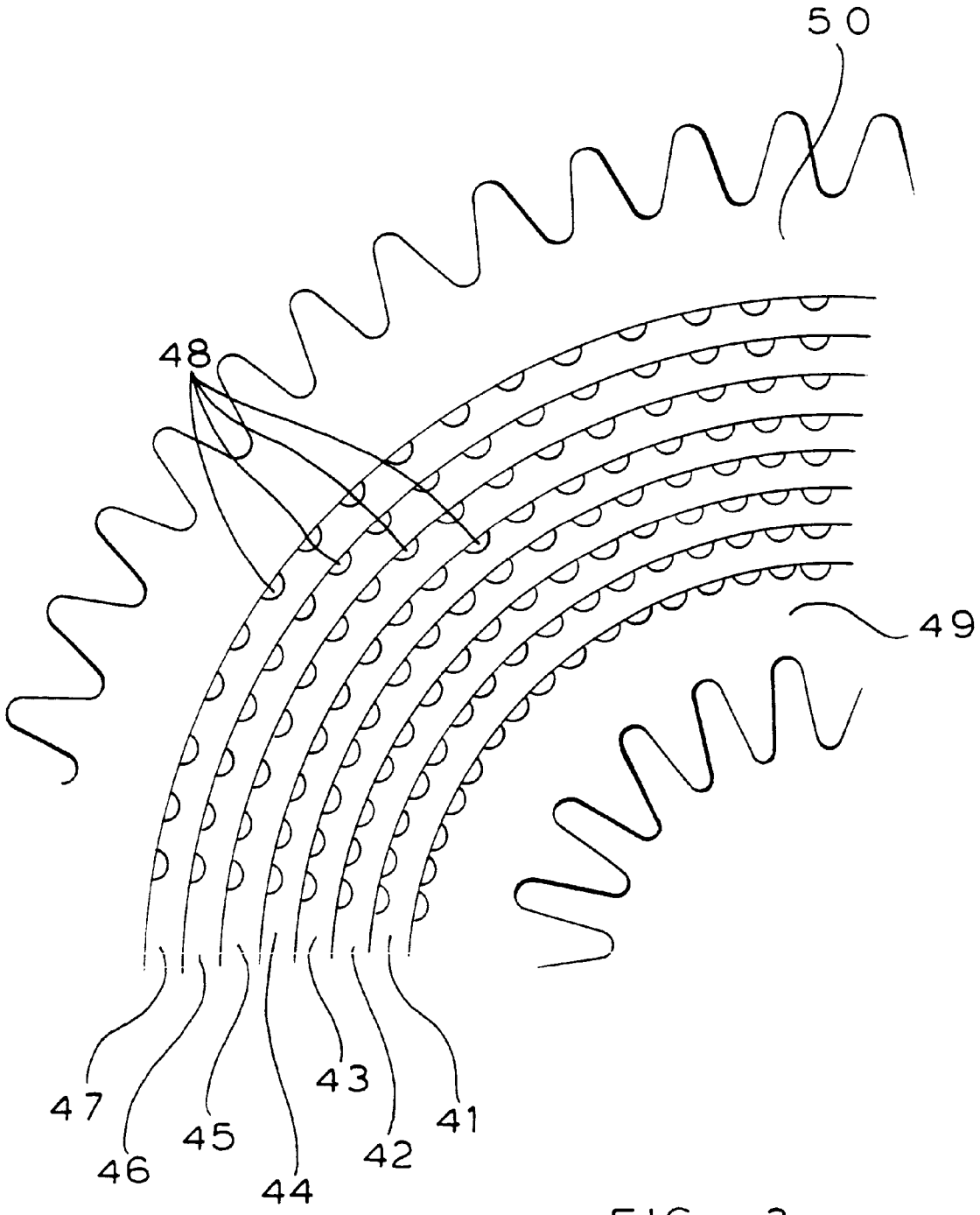
FIG. 3 illustrates a multi-sleeve arrangement which may replace the single sleeve of an element such as that of FIG. 1.

FIG. 3 shows an alternative sleeve arrangement. Concentric sleeves 41 to 47 are each provided with longitudinal external main grooves such as 48. Typical main grooves in sleeves of 1 mm thickness are of the order of 0.7 mm deep (radially) and 0.5 mm across (circumferentially) and are spaced apart to provide lands between them for heat conduction. The sleeves are all in intimate contact with each other. During assembly, successive sleeves are typically slip fitted over an inner tube 49 and an outer tube 50 is then shrink fitted over them. Electron beam welding could be employed in place of slip and/or shrink fitting to achieve the required intimate contact.

In the multi-sleeve arrangement of FIG. 3 the sleeves are made up of an inner sub-set 41–43 and an outer sub-set 44–47. All the sleeves of the inner sub-set have the same number of main grooves as one another as does the outer surface of the inner tube. Thus the lands between main grooves are in direct radial alignment from one sleeve to the next, and from the sleeve 41 to the inner tube 49 to provide an effective direct heat conduction path to or from the inner tube. All the sleeves of the outer sub-set 44–47 also have the same number of grooves as one another but a greater number than the inner sub-set 41–44 commensurate with the larger sleeve diameter to achieve broadly similar land widths in the inner and outer sub-sets. The lands of the outer sub-set 44–47 are similarly be arranged in direct alignment to give effective heat conduction to the outer tube which is in direct contact with the second fluid.

In an alternative arrangement, all sleeves have the same number of grooves as one another and the lands of all the sleeves are aligned radially providing greatest possible strength.

This multi-sleeve arrangement may be employed in place of the single sleeve 13 of FIG. 1 with suitable adjustment of the size of the inner and outer tubes to accommodate the sleeves. As in FIG. 1, the main groove arrangement may be varied, with either one or two sets of main grooves at each interface between sleeves and at each interface between a sleeve and a tube. A multi-sleeve arrangement of this kind can provide a high performance compact heat exchanger element which is particularly suitable for use as the cooler of a working fluid in a Stirling engine.

Figure 4:
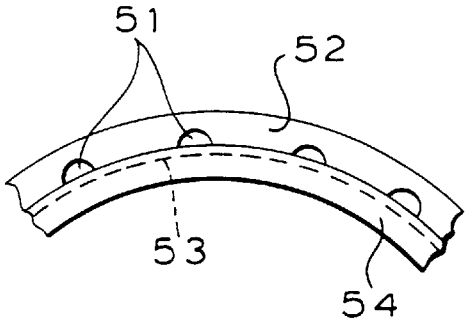
FIG. 4 is a diagrammatic cross section.
Figure 5:
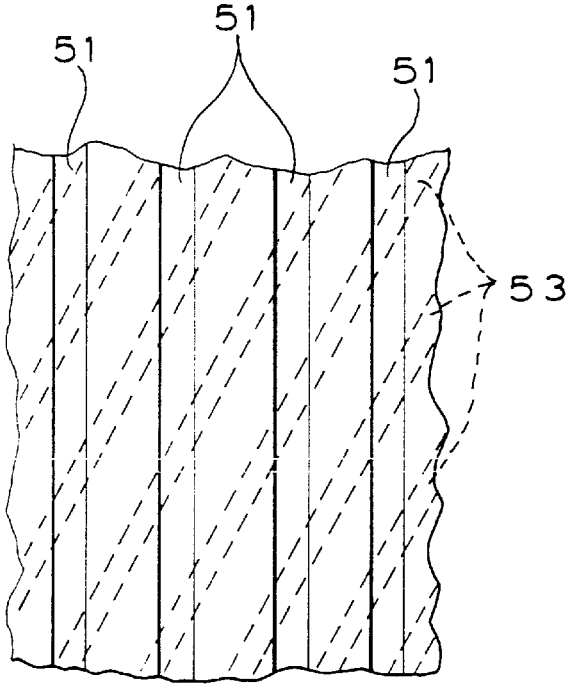
FIG. 5 is a corresponding elevation of a typical main and secondary groove pattern.

FIGS. 4 and 5 show an alternative groove arrangement in which the main grooves such as those of FIG. 1 are supplemented by secondary inclined grooves. Longitudinal main grooves 51 on the inner surface of an outer tube 52 are supplemented by inclined secondary grooves 53 on the outer surface of sleeve 54. These secondary grooves form slots which extend from one main groove 51 to the next. As heat exchange fluid flows along main grooves 51, it meets the inclined secondary grooves 53 and tends to be deflected through the slots by virtue of its forward motion. Depending on the entry and exit conditions for each slot, either or both may tend to induce such flow. This flow through the slots tends to impart spiral flow within each main groove thereby augmenting effective heat transfer. In the embodiment of FIGS. 4 and 5, the secondary grooves 53 traverse the main grooves 51, adding a further potential for turbulence as opposed to laminar flow. The secondary groove configuration, e.g. the angle, size or spacing, may vary from one part of the element to another.

Figure 6:
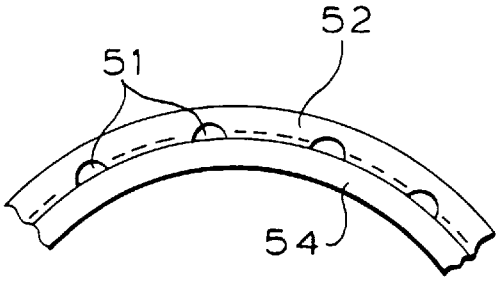
FIGS. 6 and 7 are views corresponding to FIGS. 5 and 6 of an alternative groove arrangement.
Figure 7:
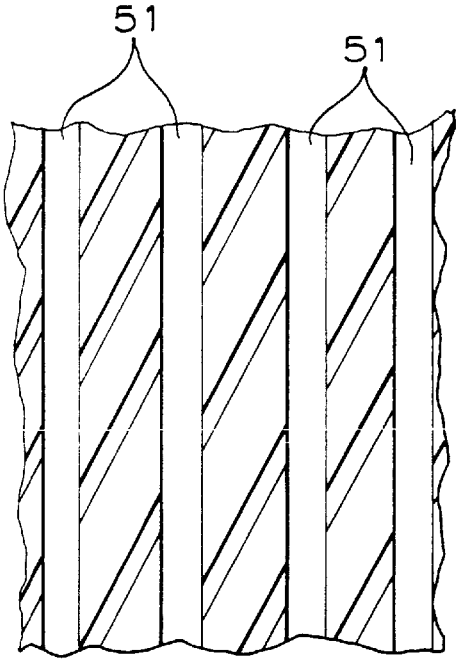

FIGS. 6 and 7 show a variation on the arrangement of FIGS. 4 and 5. In this case, both the main grooves and the secondary grooves forming the slots are provided in the outer tube.

The arrangement of FIGS. 4 and 5 or of FIGS. 6 and 7 may be provided at any interface and would normally be provided at all interfaces. These arrangements can also be applied with obvious modification to groove arrangements other than that shown in FIG. 1 at A.

Except in the case where the sleeve is used primarily as a separator, the materials for the tubes and sleeves should be selected to give the required heat conduction properties.

In general, the groove and sleeve arrangement can be used to achieve heat exchanger elements with accurately defined low volume flow passages with large heat transfer areas resulting in high heat transfer areas for small fluid volume with an acceptable resistance to flow through the passages. Manufacturing costs can also be kept within acceptable limits.

The multi-sleeve arrangement is particularly suitable for a Stirling engine cooler, which operates at a lower temperature and a lower temperature differential than a Stirling engine heater.

I claim:

1. A heat exchanger element comprising an outer tube (11), an inner tube (12) within the outer tube, the annular space between the inner and outer tubes defining a first fluid flow path for a first heat exchange of fluid, an inlet connector (21 or 22) for supplying a first fluid to an inlet end of the first fluid flow path and an outlet connector (22 or 21) for receiving first fluid from an outlet end of the first fluid flow path, and a second fluid flow path (33, 34, 35) for a second heat exchange fluid to flow in heat transfer relationship to the outer surface of the outer tube and/or the inner surface of the inner tube; wherein a sleeve (13) is disposed between the inner and outer tubes, said sleeve dividing the first fluid flow path into a plurality of sets of passageways (16, 17), the passageways extending generally longitudinally from the inlet end to the outlet end of the first fluid flow path, the passageways of each set of passageways being spaced angularly of the other passageways of the set and each set of passageways being spaced radially of the other set or sets.

2. A heat exchanger element as claimed in claim 1 wherein the sleeve (13) is in effective heat transfer contact with at least one of the tubes (11 or 12).

3. A heat exchanger element as claimed in claim 1 wherein the grooves (51, FIGS. 4 and 5) forming the first heat exchange fluid flow path are main grooves and wherein secondary grooves (53) at an inclination to the main grooves are provided at an interface to provide slots between the main grooves for inducing fluid flow from one main groove to the adjacent main groove.

4. A heat exchanger element as claimed in claim 3 wherein the main grooves (51) are in one surface at the interface and the secondary grooves (53) are in the other surface at the interface.

5. A heat exchanger element as claimed in claim 3 having main grooves (at B, C, FIG. 1) in both surfaces at an interface.

6. A heat exchanger element as claimed in claim 5 wherein the main grooves in one surface of an interface are in register with the main grooves of the other surface of the same interface to provide in effect larger main grooves (at B, FIG. 1).

7. A heat exchanger element as claimed in claim 5 wherein the main grooves in one surface are out of register with the main grooves in the other surface to provide separated main grooves (at C, FIG. 1).

8. A heat exchanger element as claimed in claim 1 comprising at least two concentric sleeves (41, 42, 43 etc.—FIG. 3) between the inner and outer tubes with interfaces between adjacent sleeves as well as between the outer sleeve and the other tube and between the inner sleeve and the inner tube, with generally longitudinal main grooves (48) at each interface.

9. A heat exchanger element as claimed in claim 8 having an inner sub-set of sleeves with a common number of main grooves in radial register with one another and an outer sub-set of sleeves with a larger common number of main grooves in radial register with one another.

10. A Stirling engine comprising a single multi-sleeve heat exchanger element as claimed in claim 1 used as a cooler for the working fluid of said Stirling engine.

11. A Stirling engine comprising a bank of heat exchanger elements as claimed in claim 1 used as a heater for the working fluid said Stirling engine.

12. A heat exchanger element according to claim 1 wherein the passages are defined by generally longitudinal grooves formed at each interface between the inner surface of the sleeve and the outer surface of the inner tube and the outer surface of the sleeve and the inner surface of the outer tube.

* * * * *